US006864789B2

(12) United States Patent
Wolfe

(10) Patent No.: US 6,864,789 B2
(45) Date of Patent: Mar. 8, 2005

(54) PERSONAL PROPERTY SECURITY DEVICE

(75) Inventor: Daniel G. Wolfe, Highland, UT (US)

(73) Assignee: Red Wolf Technologies, Inc., Orem, UT (US)

( * ) Notice: Subject to any disclaimer, the term of this patent is extended or adjusted under 35 U.S.C. 154(b) by 0 days.

(21) Appl. No.: 09/943,813

(22) Filed: Aug. 31, 2001

(65) Prior Publication Data

US 2002/0070856 A1 Jun. 13, 2002

Related U.S. Application Data

(60) Provisional application No. 60/230,608, filed on Sep. 6, 2000.

(51) Int. Cl.[7] ..... G08B 1/08

(52) U.S. Cl. ..... 340/539.1; 340/539.13; 340/539.22; 340/539.25

(58) Field of Search ..... 340/539.1, 568.1, 340/571, 572.1, 539.11, 539.13, 539.31, 539.32, 568.7, 539.22, 539.25, 426.21

(56) References Cited

U.S. PATENT DOCUMENTS

| | | | | |
|---|---|---|---|---|
| 3,309,689 A | | 3/1967 | Keeney | |
| 3,476,948 A | | 11/1969 | Mengers | |
| 3,863,239 A | | 1/1975 | Campman | |
| 3,955,184 A | | 5/1976 | Cinzori et al. | |
| 5,200,735 A | | 4/1993 | Hines | |
| 5,309,145 A | | 5/1994 | Branch et al. | |
| 5,440,292 A | | 8/1995 | Bedrosian | |
| 5,463,595 A | | 10/1995 | Rodhall et al. | |
| 5,565,844 A | | 10/1996 | Bedrosian | |
| 5,587,701 A | | 12/1996 | Hess | |
| 5,652,567 A | | 7/1997 | Traxler | |
| 5,793,283 A | * | 8/1998 | Davis | 340/426 |
| 6,118,375 A | | 9/2000 | Duncan | |
| 6,130,610 A | | 10/2000 | Schilsky et al. | |
| 6,181,244 B1 | | 1/2001 | Hall et al. | |
| 6,239,700 B1 | * | 5/2001 | Hoffman et al. | 340/539 |
| 6,259,367 B1 | * | 7/2001 | Klein | 340/572.1 |
| 6,265,966 B1 | * | 7/2001 | Ireland et al. | 340/426 |
| 6,380,850 B1 | * | 4/2002 | Parker | 340/506 |
| 6,462,654 B1 | * | 10/2002 | Sandelman et al. | 340/506 |

* cited by examiner

*Primary Examiner*—Daryl Pope
(74) *Attorney, Agent, or Firm*—Madson & Metcalf

(57) ABSTRACT

A security device for monitoring personal property using a wireless interface to a communication network is presented. The device is comprised of a security module that interfaces with a wireless transceiver such as a cellular telephone. The security module includes a detection monitor the alarms upon a condition and initiates a dialing command to the wireless telephone. The wireless telephone includes a pre-programmed number of a user and is readily reprogrammable to other numbers. Once the communication link is established, the user may listen to the audible conditions around the security device and determine the legitimacy of the alarm. Optional enhanced interrogation of the security device is also contemplated. The security device further includes a location identifier, an example of which is a tracking transmitter that emits a beacon signal for tracking by the user or others.

29 Claims, 13 Drawing Sheets

PERSONAL PROPERTY SECURITY DEVICE

CROSS-REFERENCE TO RELATED APPLICATIONS

This application claims priority to the provisional patent application entitled: "Personal Property Security Device," Ser. No. 60/230,608, filed Sep. 6, 2000 to Daniel G. Wolfe.

BACKGROUND OF THE INVENTION

1. The Field of the Invention

The present invention relates to novel systems and methods for providing personal property security. More specifically the present invention relates to a device for providing automated notice of disturbances to personal property and automated tracking of movement of the personal property.

2. The Relevant Technology

Many personal, corporate or government property items of all types are very vulnerable to theft and vandalism with no effective or economical means of protecting them. Monitored security systems are seldom effective and usually expensive. Such monitored security systems are also not mobile and are slow to respond to trouble. Thieves and vandals of small items are seldom caught, and the personal property is seldom recovered. The police are frustrated and usually ineffective in recovering stolen personal property.

What is needed is a device for securing personal property that is portable, simple, inconspicuous, effective, and economical. Such a device would be highly effective in providing notification of disturbances to personal property and would be sufficiently economical to be purchased by a wide cross-section of consumers. Such a device would inconspicuously protect a wide array of personal property, including without limitation vehicles, power tools, bicycles, trailers, boats, stereos, televisions, and the like. Upon disturbance of personal property, such a device would be effective to provide notification of the disturbance and provide tracking information regarding any movement of the personal property to enable identification and apprehension of the perpetrator(s) and enable quick recovery of the property.

BRIEF SUMMARY OF THE INVENTION

The security system of the present invention allows a user to develop a security monitoring system for securing or monitoring personal property without subscribing to a security monitoring company or undertaking rigorous installation of sensors and infrastructure. The present invention allows a user to (i) purchase or otherwise procure a security module that couples to cellular or other wireless transceiver and is operational over generally available wireless networks, (ii) attach or have attached the security device (e.g., security module and wireless transceiver, or alternatively, an integrated composition of both functionalities) to personal property, person, (iii) activate a detection sensor within the security module, and (iv) upon alarming, the security module initiates a dialing command to the wireless transceiver, which either executes a dialing command received from the security module or employs a preprogrammed dialing string within the wireless transceiver to establish a communication link with the user telephone over a wireless (e.g., cellular, PCS, satellite, etc.) network.

The user receives the call from the security device and may evaluate the legitimacy of the alarm state through listening to audible sounds originating in the proximity of the security device. Additionally, the user may also employ optional interrogation sensors (e.g., imagery, infrared, motion, temperature, etc.) located about the security device to further legitimize the alarm state.

Once an alarm has been verified, a location identifier within the security device may be activated to enable tracking of the personal property by the user. Activation of the tracking may be performed by the user initiating a decodable keypad sequence recognized by the security device or activation may be time delayed or even immediate upon detection of an alarm condition. Tracking may assume one of several approaches, such as a transmitting beacon located within the security device that may be detected by a tracking receiver used by the user, or a receiving location-based system (e.g., GPS) which allows the coordinates of the security device to be determined and forwarded to the user over the communication link.

The apparatus of the present invention has been developed in response to the present state of the art, and in particular, in response to the problems and needs in the art that have not yet been fully solved by currently available personal property security devices and systems. Thus, it is an overall objective of the present invention to provide a personal property security device that provides effective security of personal property without the problems described above. These and other objects, features, and advantages of the present invention will become more fully apparent from the following description, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in the Figures, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1:
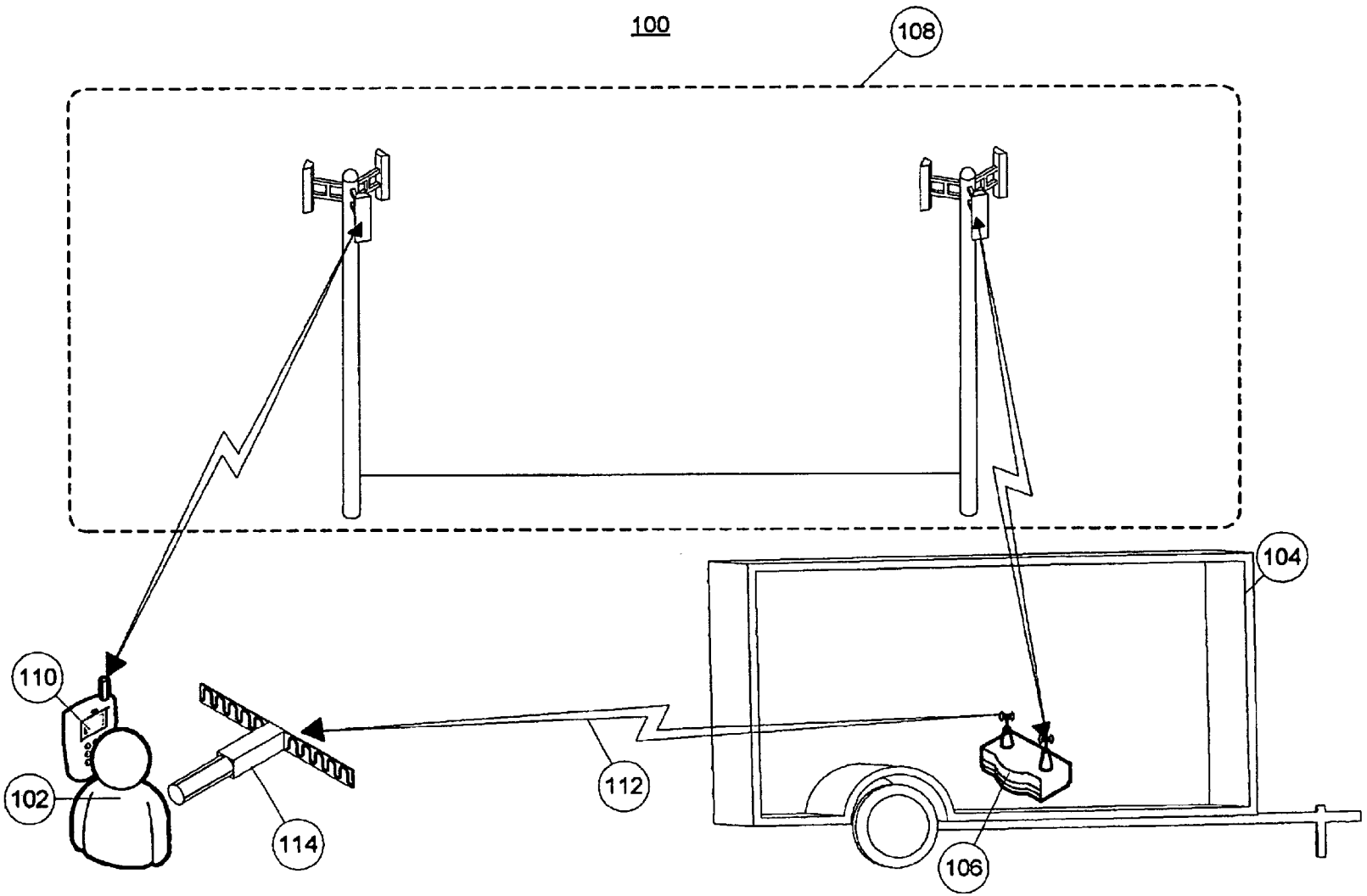
FIG. 1 illustrates an exemplary environment and configuration, in accordance with the preferred embodiment of the present invention.

FIG. 1 illustrates a system 100 for securing personal property and detecting and tracking an unauthorized or unanticipated intrusion or removal of personal property. As illustrated, a user 102 desires to secure a personal property asset 104, which may be of various forms including mobile assets, stationary assets, subject to intrusion or other types of property whose status and/or location may be of interest to user 102. The present invention facilitates the monitoring of such assets through the inclusion of a security device 106 within the confines or surroundings of personal property 104. A user activates security device 106 to monitor or be aware of surroundings about security device 106.

Upon the triggering or happening of certain events or conditions, security device 106 autonomously contacts user 102 by initiating a communication link through a communication network 108 to a user transceiver 110. Upon such notification, user 102 may perceive audible and/or other surroundings about security device 106 including information prepared and delivered by security device 106 to user transceiver 110. User 102 may respond to such information in various manners. User 102 may evaluate audible sounds and determine whether such audible information necessitates further reactions such as notifying proper authorities or if the personal property 104 has been removed to another location, identifying such location either through the use of the detection of a tracking signal 112 emanating from security device 106 through the use of a tracking receiver 114 or through the evaluation of other packaged location information dispatched from security device 106 either through a separate communication channel or through communication network 108 to user transceiver 110.

Figure 2:
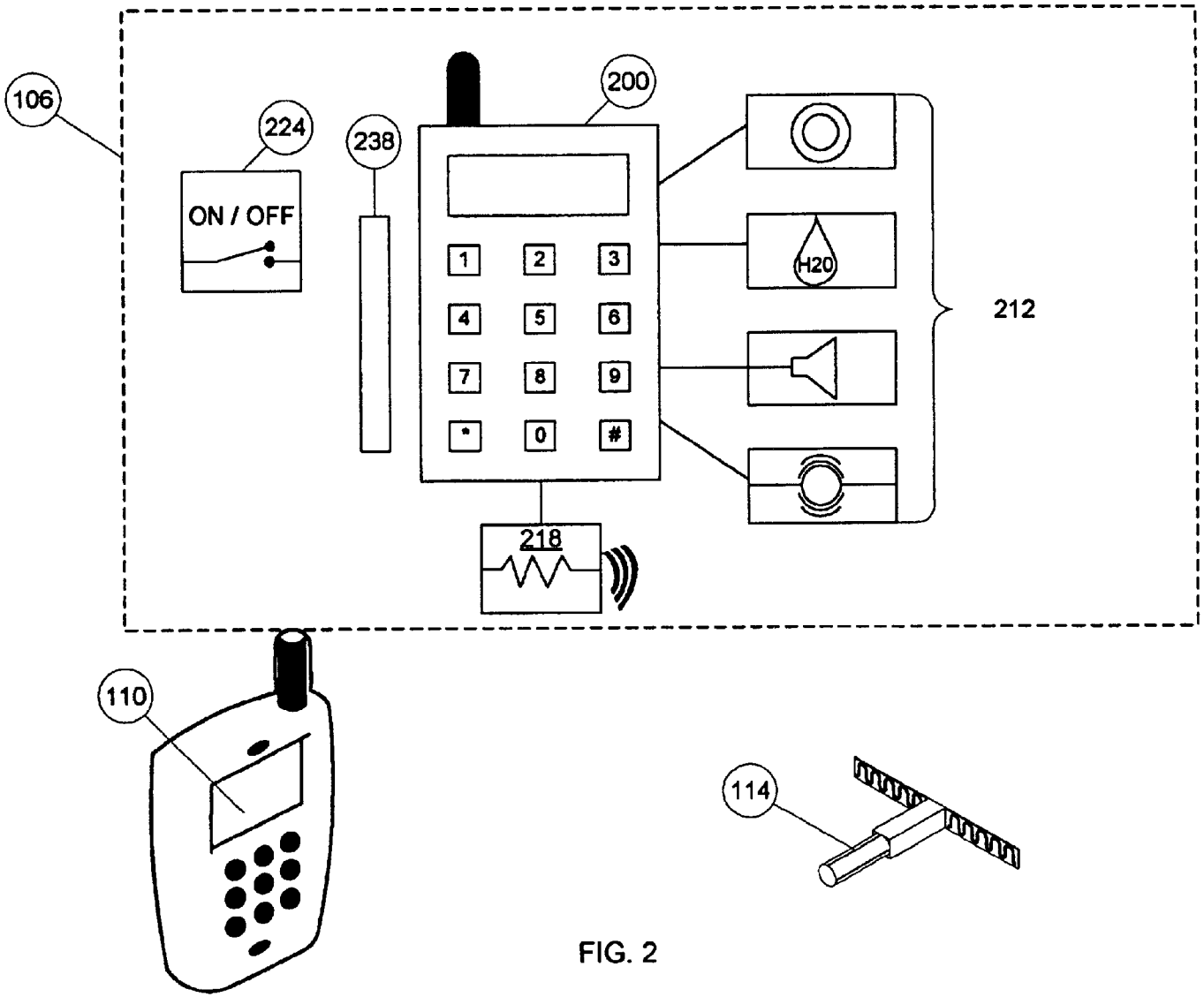
FIG. 2 illustrates a block diagram of the security system, in accordance with the preferred embodiment of the present invention.

Referring now to FIG. 2, a personal property security device "PPSD" or "security device," in one embodiment, may include a combination of several electronic devices. The security device may include a digital and/or analog cellular transceiver 200. The transceiver 200 may be used for several purposes. First, transceiver 200 may be configured to be activated and deactiviated by means of a remote transmission from another cellular telephone. In selected embodiments, a special switch may be installed to activate and deactivate transceiver 200. Once transceiver 200 is activated, it is in the ready mode to call-out to a preprogrammed number (typically corresponding to the cellular telephone of the owner of the personal property or another number designated by the owner) to provide notification of a disturbance to the personal property.

In one presently preferred embodiment, when transceiver 200 receives a disturbance signal from a triggering device or detection sensor 212, the transceiver 200 automatically calls the preprogrammed number and remains on and in the transmitting mode. The user's telephone may recognize where the call originated via a readily known caller identification system. The owner may also listen to the telephone to detect noises corresponding to activity in the vicinity of the security device that has contacted him. The user may be able to determine from the sounds in the area of the security device if the signal was a false alarm or if the security device has called because of an attempted theft vandalism or other serious trouble.

Transceiver 200 and/or detection sensors 212 may be connected to an on/off or activation switch 224 in FIG. 2 that can be activated by means of a remote transmission from a mobile telephone a key chain lock transmitter, (e.g., such as is commonly used on many modem automobiles to lock and unlock them) or the like. Activation switch 224 may be designed to receive a coded signal from a cellular telephone or from a key chain signal device such as is commonly used to lock and unlock an automobile. When the activation switch 224 recognizes the coded signal, it may cause other parts of the security device to be activated or deactivated as desired. Transceiver 200 may also be connected to several other electronic devices including without limitation, the devices generally described below.

First, the security device may include a triggering device or detection sensor 212, such as a motion sensor, a shock sensor or the like, and may take several different forms as needed for the specific use of the security device. The detection sensor 212 may take many different forms as the specific need of the security device may dictate and may be activated or deactivated by means of the remotely controlled on/off activation switch 224. In operation, when the security device is activated and in the ready mode, a bump, shock, or jarring; or a movement in the area of the security device will cause the detection sensor 212 to signal the transceiver 200 to call the preprogrammed number in an attempt to call for help. In certain embodiments, the detection sensors may be a simple panic button for a lady jogger to use if being attacked, or the detection sensor could be a special switch which detects water to signal a mother when her child who is wearing the security device falls into water or the like.

Second, the security device may include a location identifier 218, which in one embodiment assumes the form of a tracking transmitter. One example of tracking transmitters includes devices similar to tracking devices used to tag and track wildlife or sophisticated receiver-based tracking devices that use the Global Positioning System "GPS". The detection sensors may be configured to activate the location identifier to enable the tracking of movements of the security device. The location identifier is preferably silent in operation.

For the tracking transmitter embodiment of the location identifier, the tracking transmitter typically emits a silent radio signal that is capable of being tracked by a certain directional tracking devices such as a tracking receiver 114. For example, a simple animal tracking collar has been found to be effective in tracking movements of a security device for distances of several miles to tens of miles or more so long as substantial line of sight between the tracking transmitter and the directional tracking device was maintained. Systems capable of tracking movements of a security device at distances beyond many miles are also currently available. Another tracking embodiment uses a receiver-based location identifier to track movements of the personal property asset. On such embodiment employs the GPS system to track movements.

Third, the security device may include a long life rechargeable battery or power source 238 in FIG. 2, which typically provides power to the components of the security device that are located with the secured personal property including the transceiver 200, the on/off or activation switch 224, the triggering or detection sensors 212, and the location identifier 218. The power source 238 is typically as small as possible so that the security device may be inconspicuously attached to personal property and not be too heavy to be worn on a child's belt for such an application. For applications that use a cellular telephone as the transceiver, the power source or battery of the cellular telephone may be used to power the other components of the security device.

As described above, the security system may include a directional tracking receiver 114 in FIG. 2. The tracking receiver 114 is typically a separate device that is kept close at hand by the user of the personal property security device, when the security device is in use. The tracking receiver 114 may, for example, be attached to a personal property owner's cellular phone, such as transceiver 200 or, alternatively, incorporated into the user's wireless transceiver such that the tracking receiver 114 and the user transceiver 110 will always be together, when needed. The tracking receiver 114 may be activated by the user when the security device provides notification of a disturbance to the personal property. The tracking receiver 114 indicates which direction the personal property has been moved. The tracking receiver 114 may be designed to pick up the signal given off by the location identifier (e.g., tracking transmitter) 218. If the user has several security devices, multiple or a single location identifier (e.g., tracking receiver) may be configured to track any of the security devices in use. In embodiments that incorporate GPS technology, a screen may provide a readout of the position of the security device. Typical embodiments of the security devices may be built small and compact enough to be inconspicuous and able to be attached to most anything that a person would want to protect from theft or vandalism, or as the case may be, from other hazards.

Operationally in a cellular telephone embodiment, if a security device is activated and detects a disturbance or is triggered it will automatically send a signal to the user's cellular telephone which may include a special signal identifying the security device and alerting the user of a disturbance of the personal property item. The user can then determine if he wishes to call the police or respond to the signal himself. The user may decide to go to the location of the item being disturbed and find the thief still in the process of stealing the personal property item. The security device transceiver may also (once it is triggered) transmit to the user any sounds that it picks up in its' vicinity thereby allowing the owner to listen in on what is taking place and help determine if the disturbance was a false alarm. The security device can be totally silent so that the thief may never know that he has been detected. The user can then determine if he wants to call the police or if the disturbance was a false alarm. The security device may then also have activated its tracking transmitter when it was disturbed thereby allowing the user, if the personal property had already been removed, to track or follow the security device to its new location. This would allow the user to call the police and have the thief arrested and the personal property to be recovered.

The security device will have extremely wide application and can be adapted to be useful to almost everyone for a wide variety of protection uses. It may assume a small and compact embodiment thereby enabling it to be attached in inconspicuous places where a thief will not likely see it. It can be attached to vehicles, mobile trailers, power tools, bicycles, stereos, TVs, boats, motorcycles, etc. It may even be adapted to be activated with a panic button or water sensor and attached to children or joggers or even old persons, and the like. The security device facilitates alerting people when the wearer is disturbed or the child has fallen into water such that their location may be determined quickly and easily via the tracking capability. The user of the security device or parent of the child using the device can be more assured of knowing when trouble has occurred and can respond to the exact location of the trouble quickly. A user may desire use of multiple ones of the security devices and will be able to monitor the safety and location of several items in various locations. Each security device may be designed to give a different and identifiable signal to the user's pager or cell phone such as caller ID, so that the owner will be able to determine immediately which of his pieces of property (or children, etc.) is being disturbed. The security device is designed to be small compact and totally self contained making it portable and independent of outside power sources except for the need to be recharged periodically and is further independent of conventional telephone lines. These features make it extremely mobile and versatile.

Figure 3:
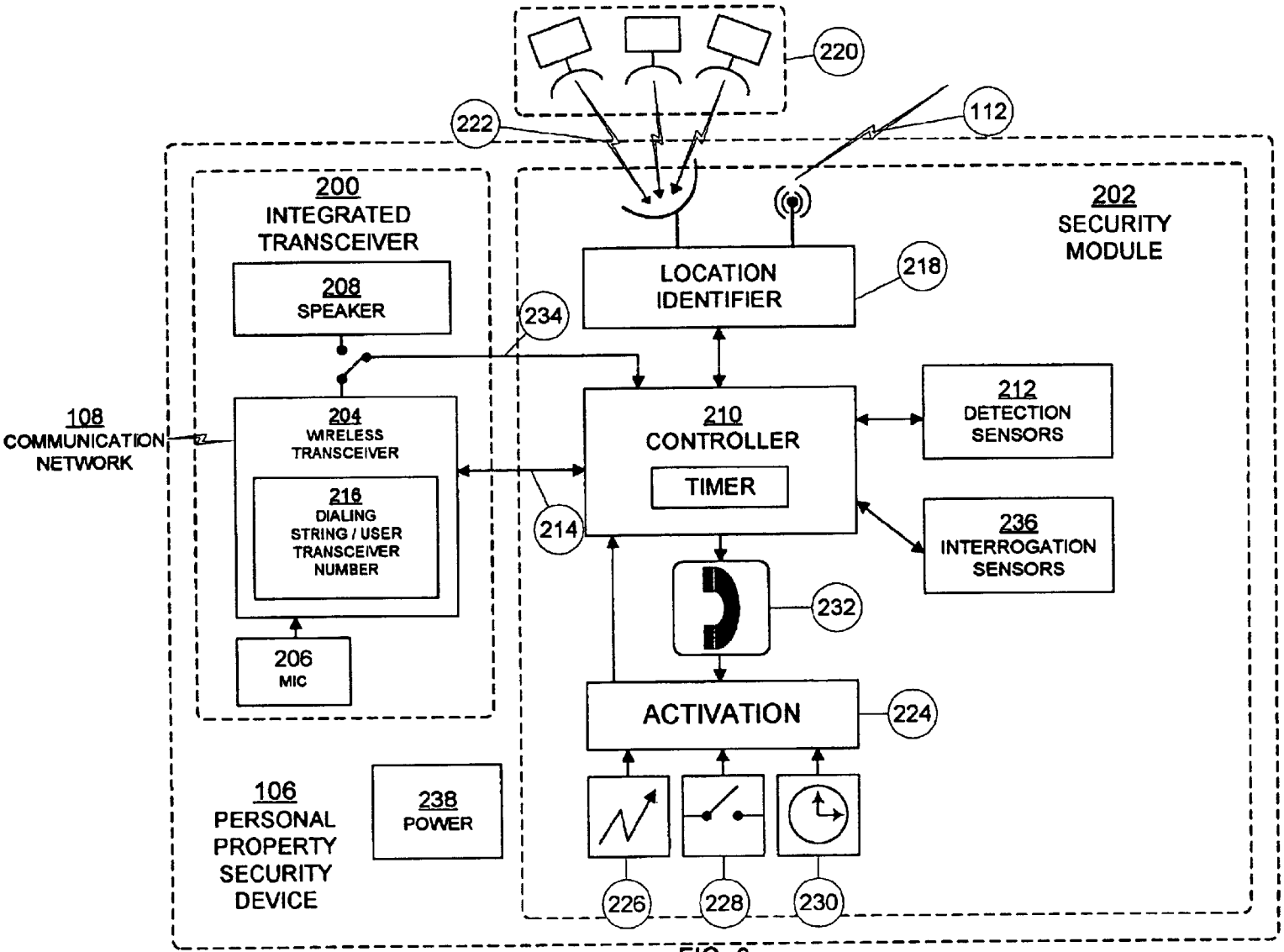
FIG. 3 illustrates a detailed block diagram of the security device in accordance with a preferred embodiment of the present invention.
Figure 4A:
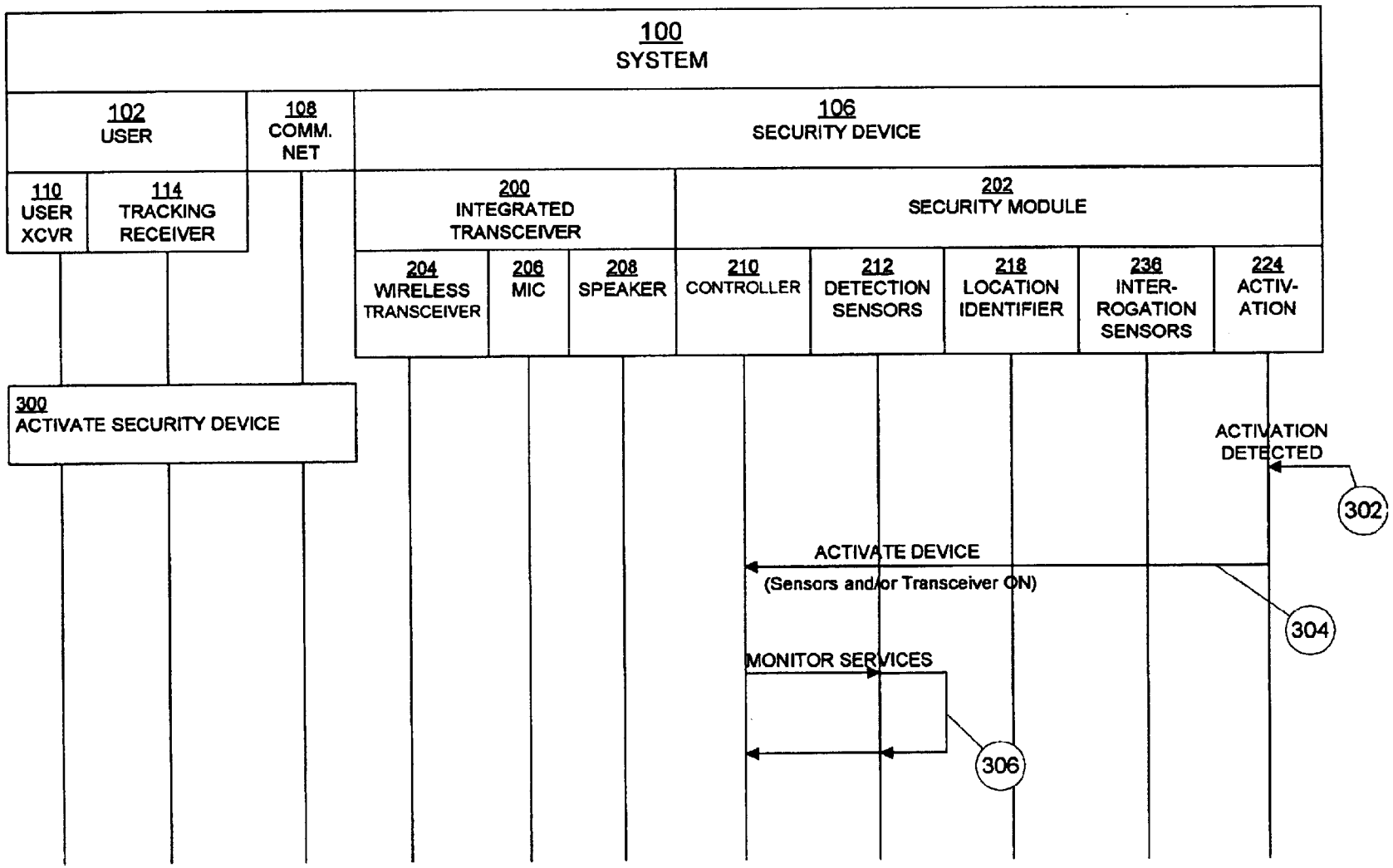
FIG. 4 is a flow diagram of the security methods implemented by the device, in accordance with the preferred embodiment of the present invention.
Figure 4B:
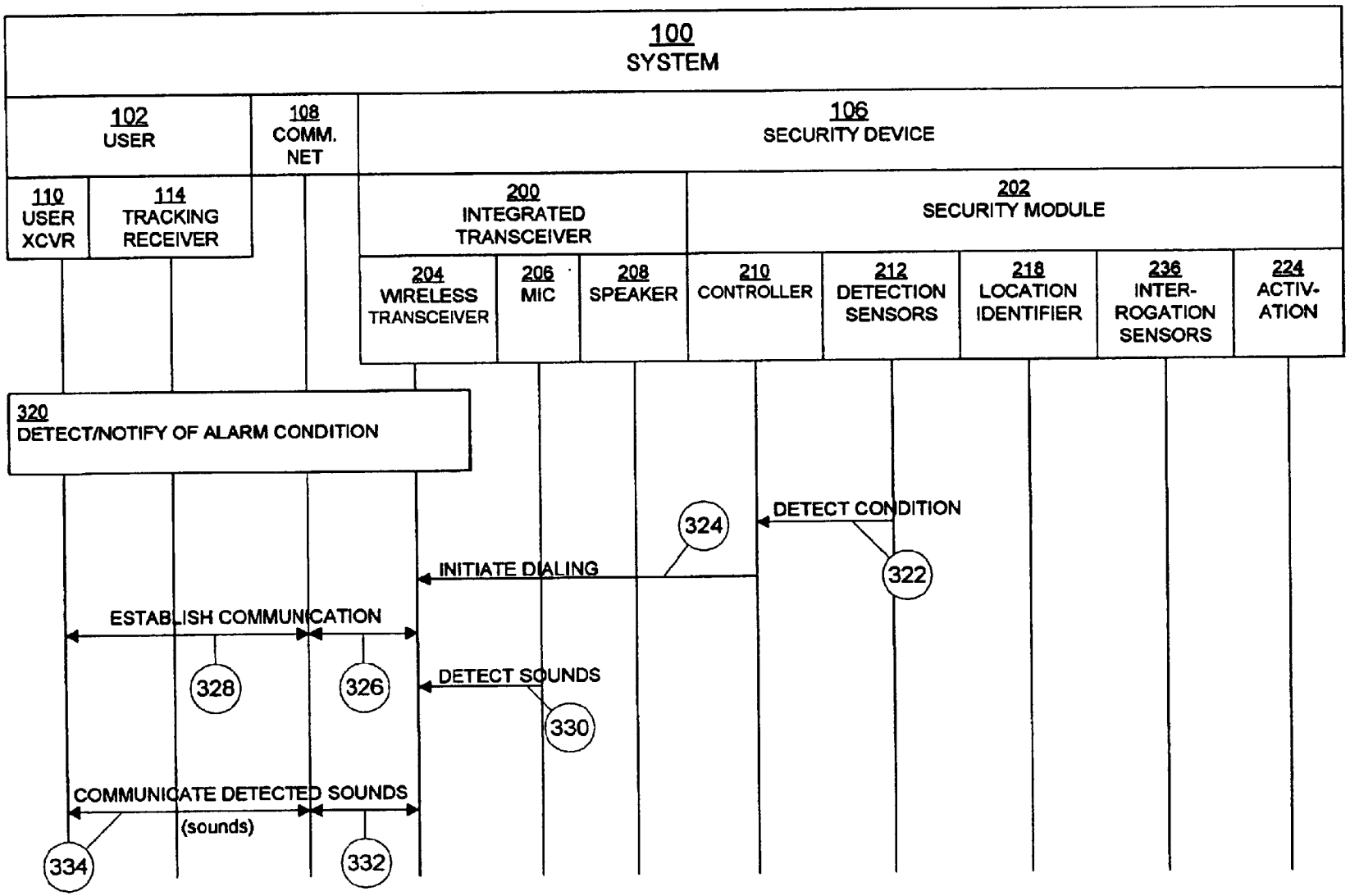
Figure 4C:
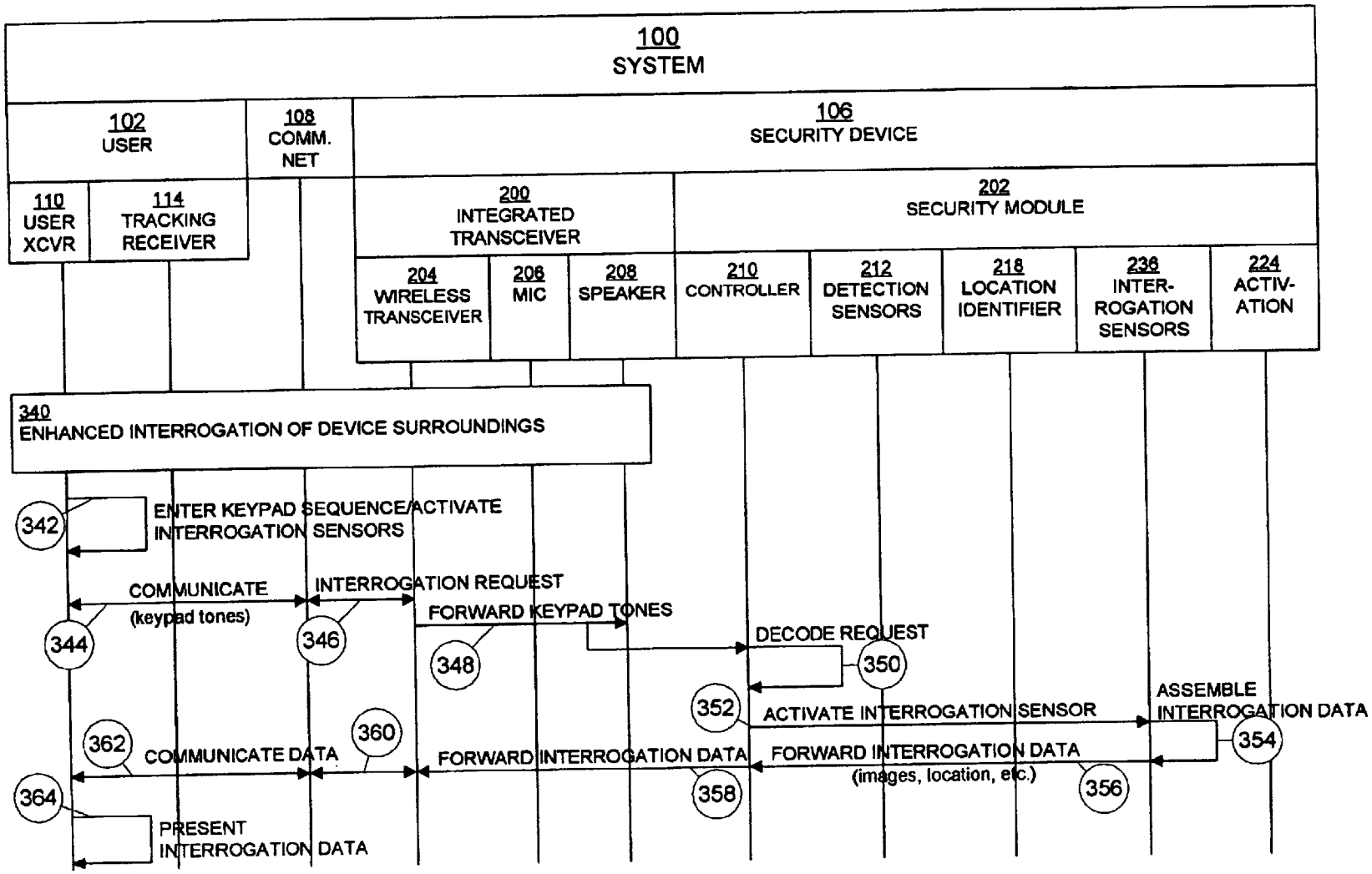
Figure 4D:
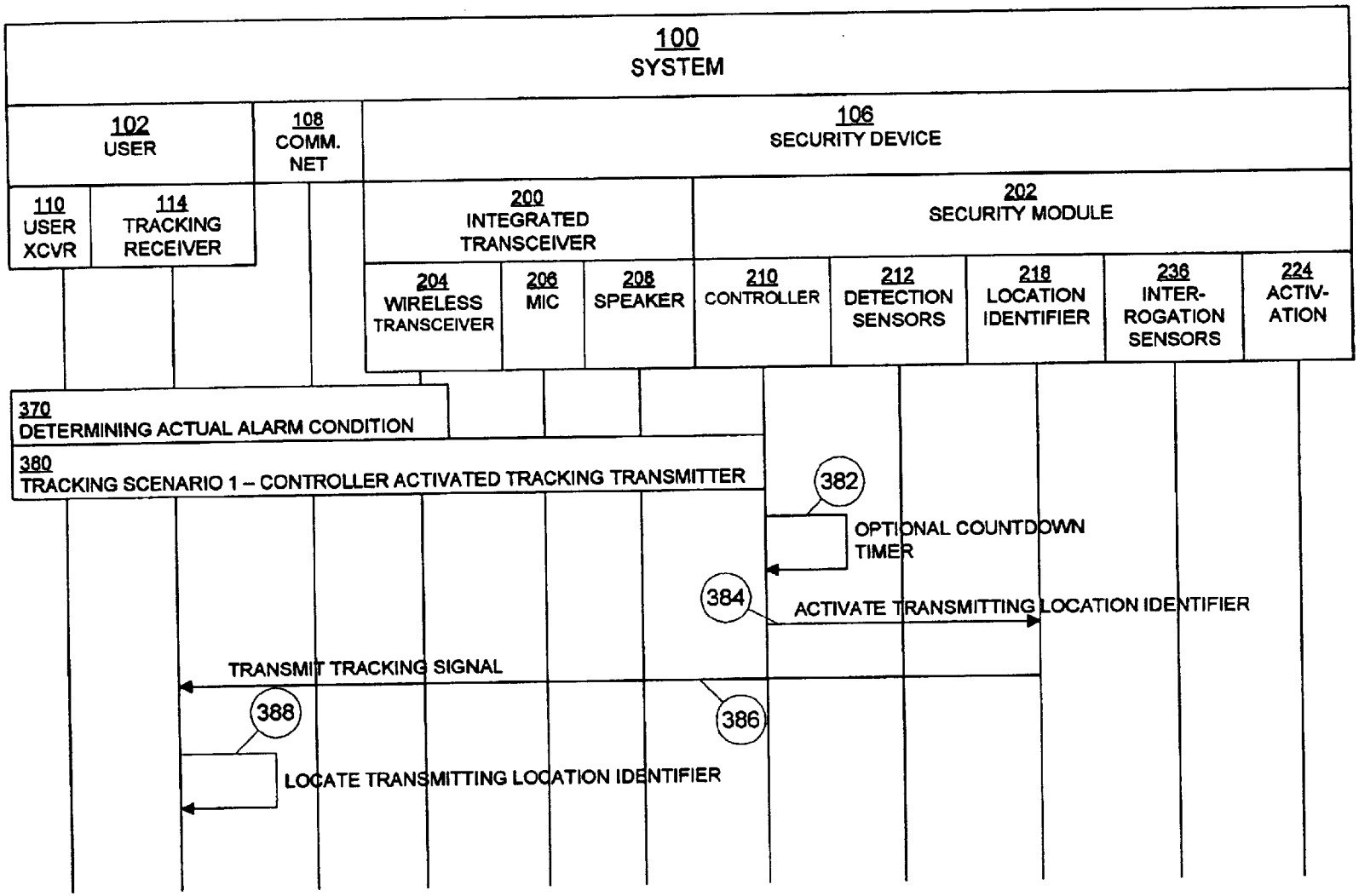
Figure 4E:
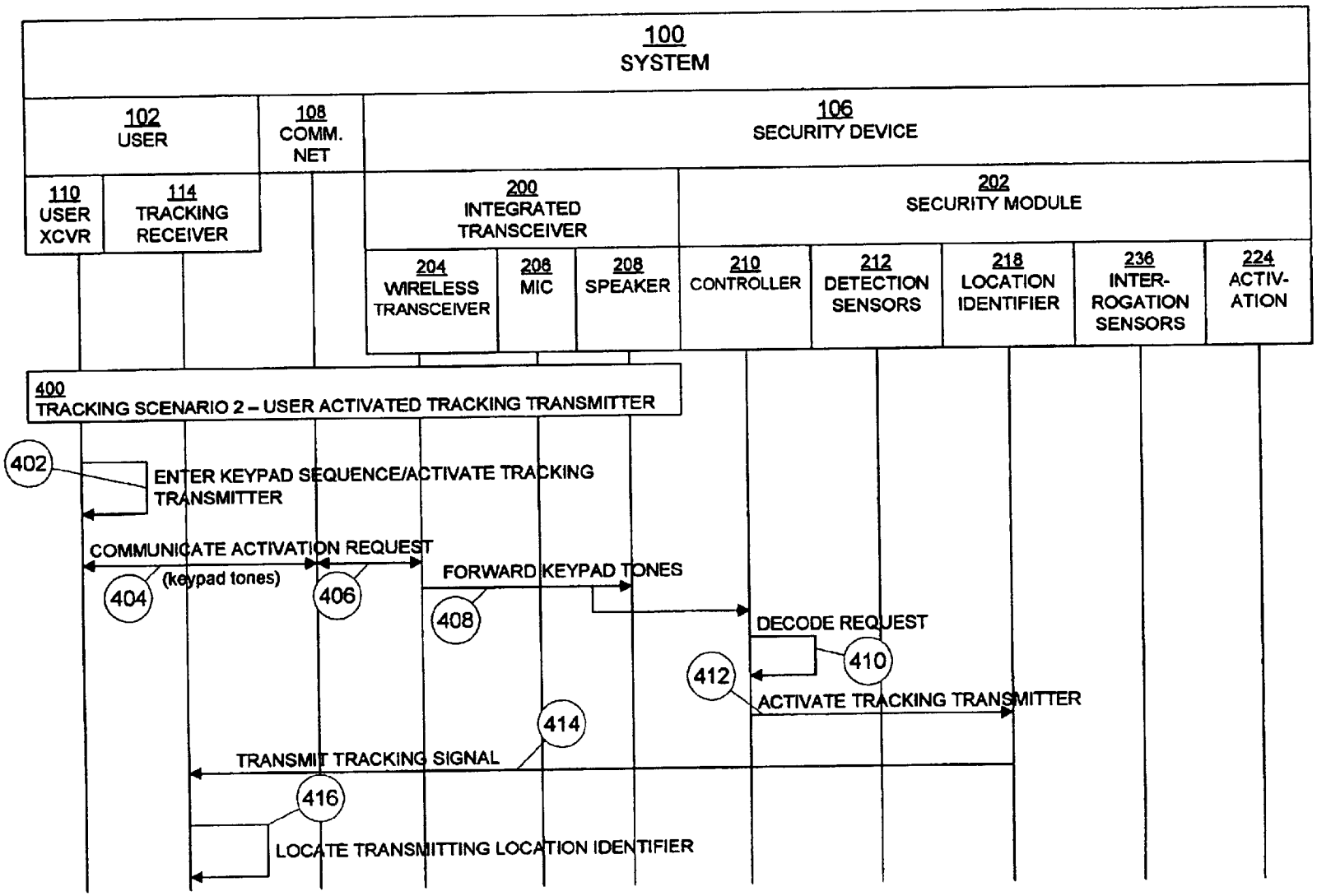
Figure 4F:
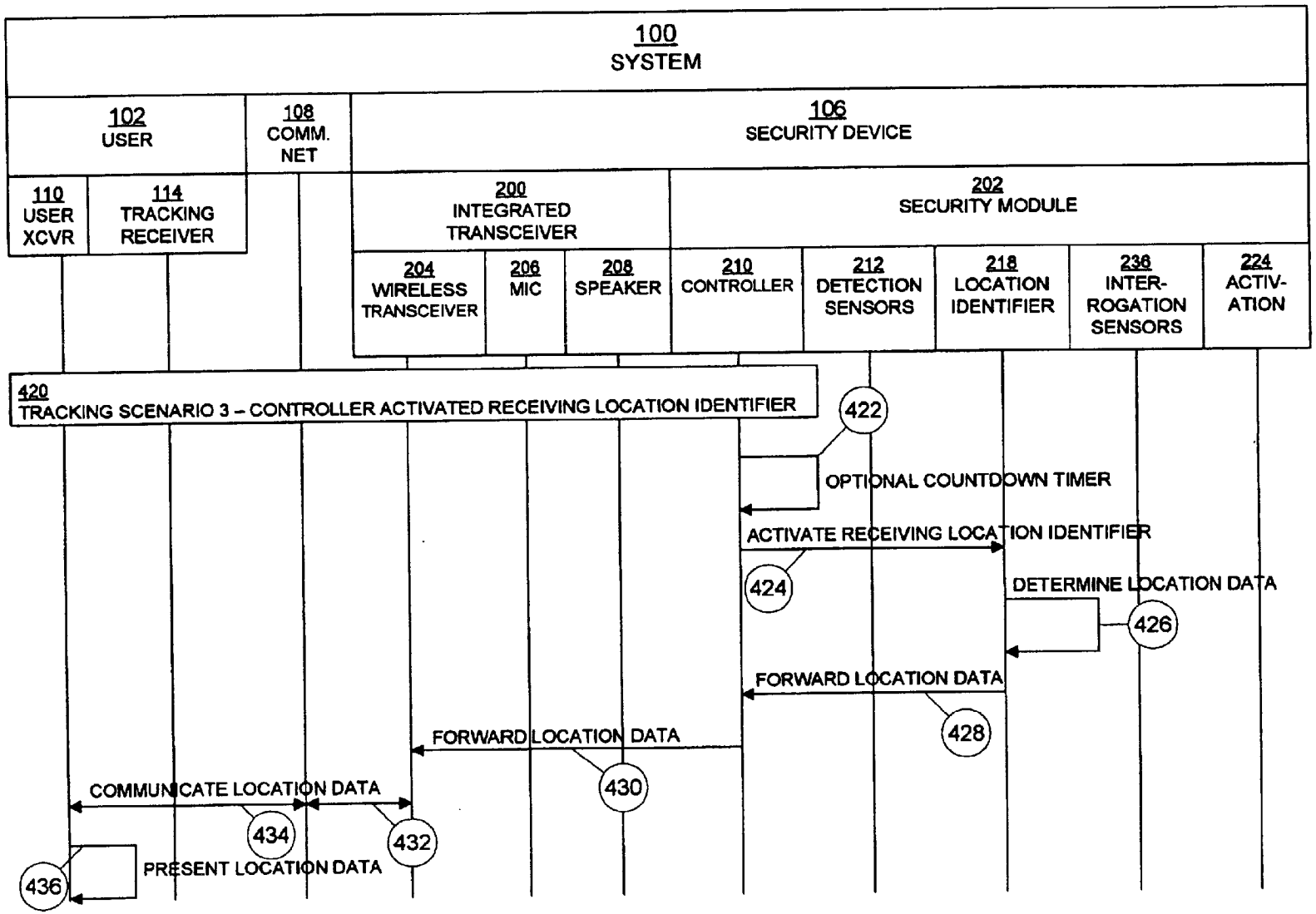
Figure 4G:
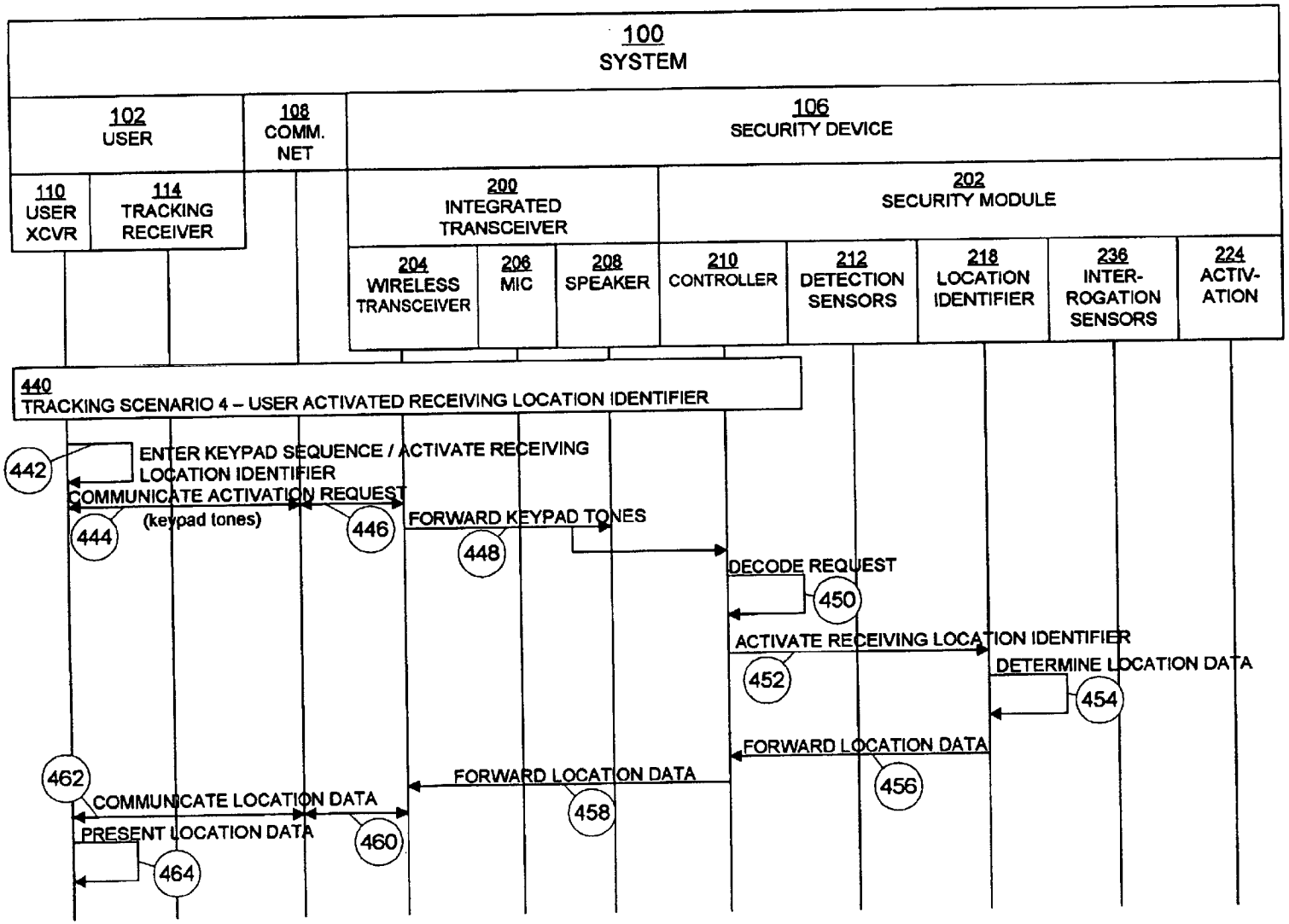
Figure 4H:
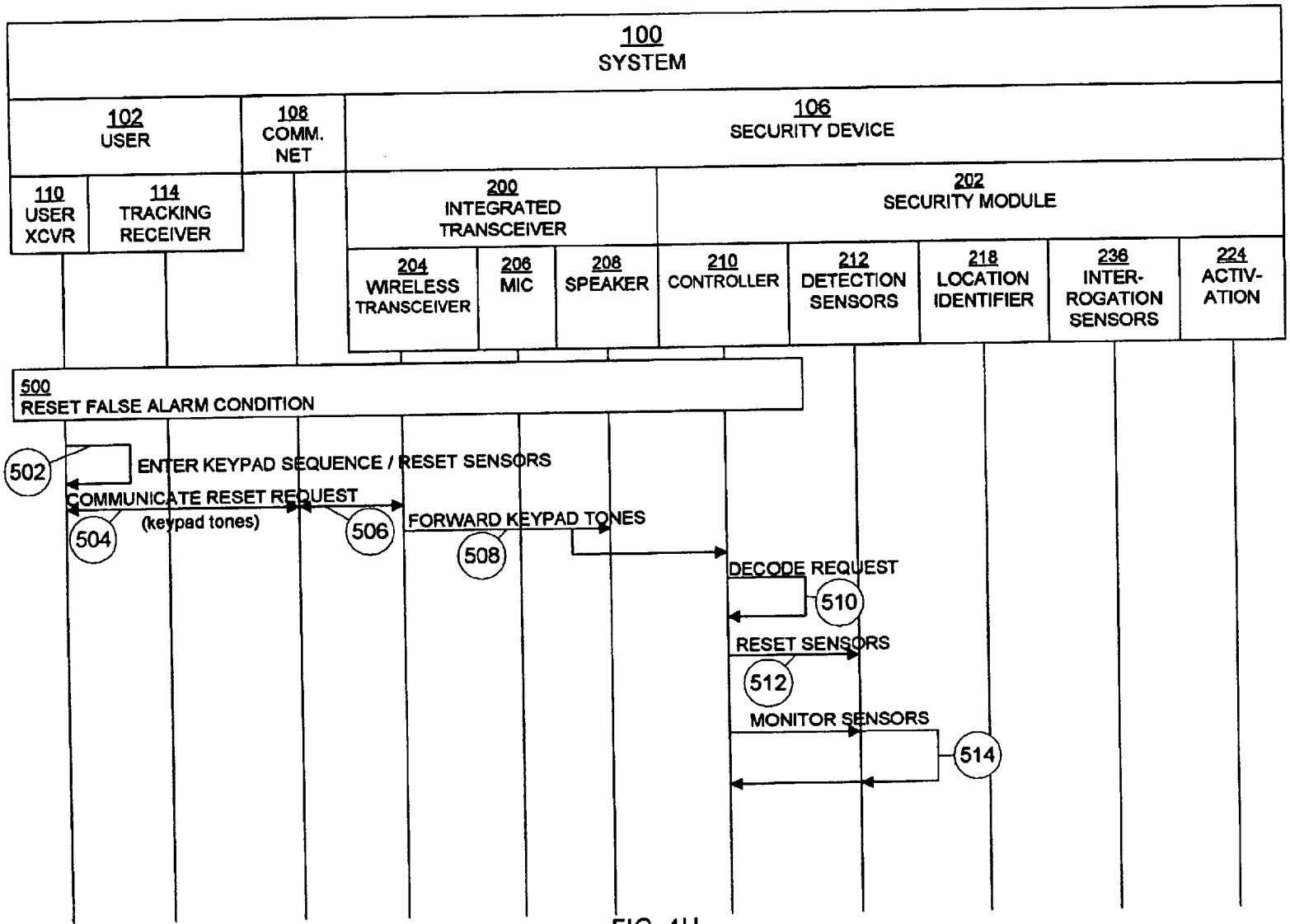

FIG. 3 is a detailed block diagram of a personal property security device 106, in accordance with the preferred embodiment of the invention. For clarity, security device 106 is partitioned into a transceiver portion for establishing a communication link with a communication network and a security or detection portion for control of sensor devices that either may be triggered or may be interrogated by the user to obtain additional information.

In FIG. 3, security device 106 is partitioned into a transceiver 200 depicted as an integrated transceiver comprised of a wireless transmitter/receiver 204 and a microphone 206 and speaker 208. Those of skill in the art appreciate that the integrated transceiver 200 may be implemented either as discrete components on a circuit board or in a packaged assembly assuming the form of, for example, a cellular or other similar telephone or two-way radio. Security device 106 is further comprised of a security module 202 for performing evaluation and control of security device and any accompanying sensors. While security module 202 may interface with transceiver 200 through various means including combined integration of (i) the various components associated with integrated transceiver 200 with (ii) the various components associated with security module 202 on a common circuit board or multiple circuit boards. When an integrated transceiver is employed, a convenient interface between the two devices may be provided by the data port or other hands-free interfaces commonly associated with integrated transceivers.

Security module 202 is comprised of a controller 210 and detection or triggering sensors 212. Detection sensors 212 may be implanted as autonomous sensors which provide an interrupt or other signal to controller 210 or may be monitored under the direction of controller 210 and implemented as a peripheral device whose state is monitored by controller 210. Controller 210 interfaces with wireless transceiver 204 via an interface 214. On the detection of sensor information, controller 210 requests a dialing sequence by wireless transceiver 204, which causes wireless transceiver 204 to initiate a call using a preset number or preprogrammed dialing string 216 which may correspond to the routing or phone number of user transceiver 110 (FIG. 1). Once a communication channel is established, controller 210 may forward sensor information or may allow audible tones detected by microphone 206 to be passed via wireless transceiver 204 to user transceiver 110.

Security module 202 may further comprise a location identifier 218 which may be under the control of controller 210 or may be autonomous and be activated by controller 210 or, alternatively, may provide information to controller 210 in the form of location data. The present invention contemplates at least two embodiments of location identifier 218. In a first preferred embodiment, location identifier 218 is implemented as a tracking transmitter or beacon which, when activated, broadcasts a tracking signal 112 which may be detected and located through the use of a tracking receiver 114 (FIG. 1). Such an embodiment is one in which location identifier 118 assumes a transmitter role.

In an alternate embodiment, location identifier 218 assumes a receiver role in which remote location transmitters 220 transmits signals 222 which are received at location identifier 218 and may be read and provide location data to controller 210 for forwarding over communication network 108 (FIG. 1) for evaluation and interpretation by user transceiver 110 (FIG. 1). Such location data may be longitudinal/latitudinal data interpretable by user 102 (FIG. 1) or other information processable by user 102 which relate to the location of security device 106. Those of skill in the art appreciate that location transmitters 220 may take the form of fixed site or orbiting types of transmitters, with one such embodiment including the GPS system, known by those of skill in the art.

Additional features contemplated by the present invention include activation circuitry 224 which allow user 102 or another entity to activate the alarming or security features of security device 106. Exemplary activation implementations contemplated by the inventor include, a remote transmission activation device depicted as transmitter activation 226, known by those of skill in the art to include devices such as "remote-keyless entry"—like devices, or similar devices known by those of skill in the art. Other such activation devices including switch activated devices 228 including manual push buttons, toggle switches or other switches activated either manually or by the closing of a door or other similar implementations. Additionally, a timing activation 230 implemented either in the form of a clock or timer is also contemplated as depicted in activation 230. Other activation implementations contemplated by the present invention further include a dial-in activation 232 wherein a user 102 via user transceiver 110 or other similar device contacts or dials integrated transceiver 200 which interacts with controller 210. In such an embodiment, controller 210 may monitor audio signals originating from user 102 which would otherwise be presented to speaker 208 of integrated transceiver 200 but are rather routed via interface 234 to controller 210 in the form of, for example, DTMF tones or similar key pad tones whose decoding and usage, are known by those of skill in the art. Such an activation keypad sequence may be decoded by controller 210 for use in activation of security device 106.

While user 102 may rely upon the information provided via detection sensors 212, and audible information for microphone 206, a further embodiment of the present invention contemplates the inclusion of interrogation sensors 236 which may take the form of an image-creating peripherals such as cameras or other sensor devices even including temperature sensors for monitoring the safety of the environment about security device 106, or other data-providing sensors such as security networks location data generating devices for use in interrogating mobile or in-transit security devices as well as other sensors, known by those of skill in the art. Security device 106 may optionally include a power module 238 for use in powering transceiver 200 and security module 202. Alternatively, power 238 may be externally provided to security device 106.

FIG. 4 is a flowchart of the operational steps, in accordance with a preferred embodiment of the present invention. A procedure 300 illustrates activation of security device 106, and as described above, activation may occur according to various means. A step 302 depicts such an activation event received by the activation module 224 which may be included within controller 210 as software or other procedural devices or may be externally generating an interrupt or other signal to controller 210, as depicted in activate device step 304. In the step 306, sensors 212 are activated and continue in a continuous monitoring state and may be implemented as sensors 212 which assume autonomous monitoring and generate an interrupt to controller 210 or may be periodically polled by controller 210.

Procedure 320 illustrates detection and notification of an alarm condition. In procedure 320, a detect condition 322 is generated either by sensor 212 or identified by control 210 in a polling arrangement. Controller 210 initiates a call request or a dialing request to wireless transceiver 204 in a step 324. Wireless transceiver 204 establishes a communication link in steps 326 and 328 via communication network 108 to a user transceiver 110. Once such a communication link is established, microphone 206 detects and forwards sounds or audible tones or other condition information to wireless transceiver 204 in a step 330. Detected or audible signals are thereafter passed across the communication link in steps 332 and 334 to user transceiver 110. The user thereafter evaluates such information and may then make an alarm legitimacy determination.

Alternatively, a user, in a procedure 340, may elect to undertake enhanced interrogation of device surroundings in an attempt to better determine whether the sensor detected condition requires emergency intervention. As described above, enhanced or interrogation sensors may be integrated with security device 106 which provide enhanced conditions such as imagery, infrared detection, or other desirable conditions helpful to a user in evaluating the surroundings about security device 106. To initiate enhanced interrogation, the present invention contemplates a user in a step 342 initiating an input sequence, for example, through the use of a keypad sequence which generates a decodable sequence, for example, DTMF tones. The keypad tones are transferred from user transceiver 110 to wireless transceiver 204 via steps 344 and 346 over the communication link either originally established as initiated by the detection of a sensor or through a user initiated communication link described below. Traditionally, keypad tones are forwarded from wireless transceiver 204 to speaker 208 in a step 348, the keypad tones are forwarded to the speaker wherein the controller may either audibly decode such tones after passing through speaker 208 or may intervene and intercept the tones and pass them to controller 210 for decoding, as depicted in the illustration. Controller 210, in a step 350, decodes the keypad tone sequence and then determines the desired request as initiated by the user. When the desired keypad tone sequence dictates enhanced interrogation, controller 210, in a step 352, activates interrogation sensors 236 to assemble interrogation data in a step 354 which may include images, location information, or other beneficial surrounding information for perception by user 102. Interrogation sensors 236 forward interrogation data in a step 356 to controller 210 which thereafter relays or forwards the interrogation data in a step 358 to wireless transceiver 204 for transmission, in steps 360 and 362, over the communication link to user transceiver 110. User transceiver 110, in a step 364, presents the interrogation data for interpretation by the user.

After either initial detection and notification of an alarm condition in procedure 320 or after further enhanced interrogation in procedure 340, a user may determine whether or not a sensed alarm condition is an actual alarm condition as described in procedure 370 or a false alarm condition as described below in procedure 500. When a user determines or elects to declare the alarm condition as an actual alarm condition, various tracking scenarios may ensue. Several of those tracking scenarios are illustrated in FIG. 4 and described below.

In procedures 380, the tracking scenario is illustrated wherein the security device initiates activation of the location identifier which assumes a tracking transmitter configuration. In a controller 210 activation scenario, a step 382 illustrates an optional countdown timer wherein the controller, upon the detection of a triggering event from detection sensors 212, delays the activation for a period of time allowing the user to evaluate and perhaps further interrogate sensors before activating the tracking signal 112. Upon the expiration of the optional countdown timer, controller 210, in a step 384 activates, transmitting location identifier 218. Location identifier 218, in a step 386, transmits tracking signal 112 which is detected by a user or other entity utilizing a tracking receiver 114. Tracking receiver 114, in a step 388, locates the transmitting location identifier 218, thus concluding tracking scenario 380.

An alternate tracking scenario is illustrated as procedure 400 which also employs a location identifier implemented as a tracking transmitter, however, in the present scenario, the tracking transmitter is activated by the user upon determination that the alarm is in fact an actual alarm rather than a false alarm. In procedure 400, a user enters a keypad sequence, in a step 402, which is communicated too wireless transceiver 204 in steps 404 and 406. Wireless transceiver 204, in step 408, forwards the keypad tone to controller 210 where upon controller 210, in a step 410, decodes the keypad tone sequence and determines the user request. Upon decoding, controller 210, in a step 412, activates the transmitting location identifier 218 which in turn, in a step 414, broadcasts or transmits tracking signal 112 to tracking receiver 114. In a step 416, tracking receiver 114 locates the transmitting location identifier 218, thus concluding procedure 400.

In yet another tracking scenario depicted as procedure 420, a location identifier 218 is implemented as a receiving location identifier that receives signals and determines a location based upon received signals. As described above, location identifier 218 may be activated by a controller in a step 422 which employs a countdown or delay timer which postpones activation of portions of the circuitry that traditionally require an appreciable amount of power in their operation. In a step 424, controller 210 activates the receiving location identifier 218 whereupon in a step 426 location identifier 218 receives signals 222 (FIG. 3) and makes a determination or an assembly of location data for forwarding in step 428 back to controller 210. The location data is further forwarded in steps 430 to wireless transceiver 204, and further in steps 432 and 434 over communication network 108 to user transceiver 110. In a step 436, the location data is presented to a user for interpretation, thus concluding tracking scenario 420.

In yet another tracking scenario depicted as procedure 440, a user activates the receiving location identifier through a keypad sequence. In a step 442, a user enters a keypad sequence requesting activation of location identifier 218. In steps 444 and 446, the keypad tones are communicated over a communication network 108 to wireless transceiver 204. Wireless transceiver 204 forwards in step 448 the keypad tones to controller 210 which in step 450 decodes the keypad tone sequence and determines that activation is requested. In step 452, controller 210 activates the receiving location identifier 218 whereupon location identifier 218 determines location data in a step 454. In a step 456, location identifier 218 forwards location data to controller 210 which further relays the location data in a step 458 to wireless transceiver 204. Over communication network 108, the location data is forwarded in steps 460 and 462 to user transceiver 110. Following which, in a step 464, the user is presented with the location data for evaluation and determination of the location of security device 106, thus concluding the tracking scenario 440.

As described above, a user when notified of an alarm condition may determine that such alarm condition is in fact benign and was generated either as the result of inadvertent sensor activation or as a result of overly sensitive sensors or transient alarm conditions acceptable to the user. Procedure 500 depicts the steps associated with the evaluation following determination of a false alarm condition. In a step 502, in response to the determination of a false alarm condition, the user enters a keypad sequence to reset the tripped or triggered sensors. The keypad tones are relayed over communication network 108 in steps 504 and 506 to wireless transceiver 204. In a step 508, wireless transceiver 210 forwards the keypad tones to controller 210 whereupon in a step 510 the controller decodes the keypad tone sequence and determines that the user has requested that the sensors be reset. Controller 210, in a step 512, initiates reset of the sensors 212 whereupon the sensors, alternatively in conjunction with controller 210, resume continues monitoring in a step 514.

Figure 5:
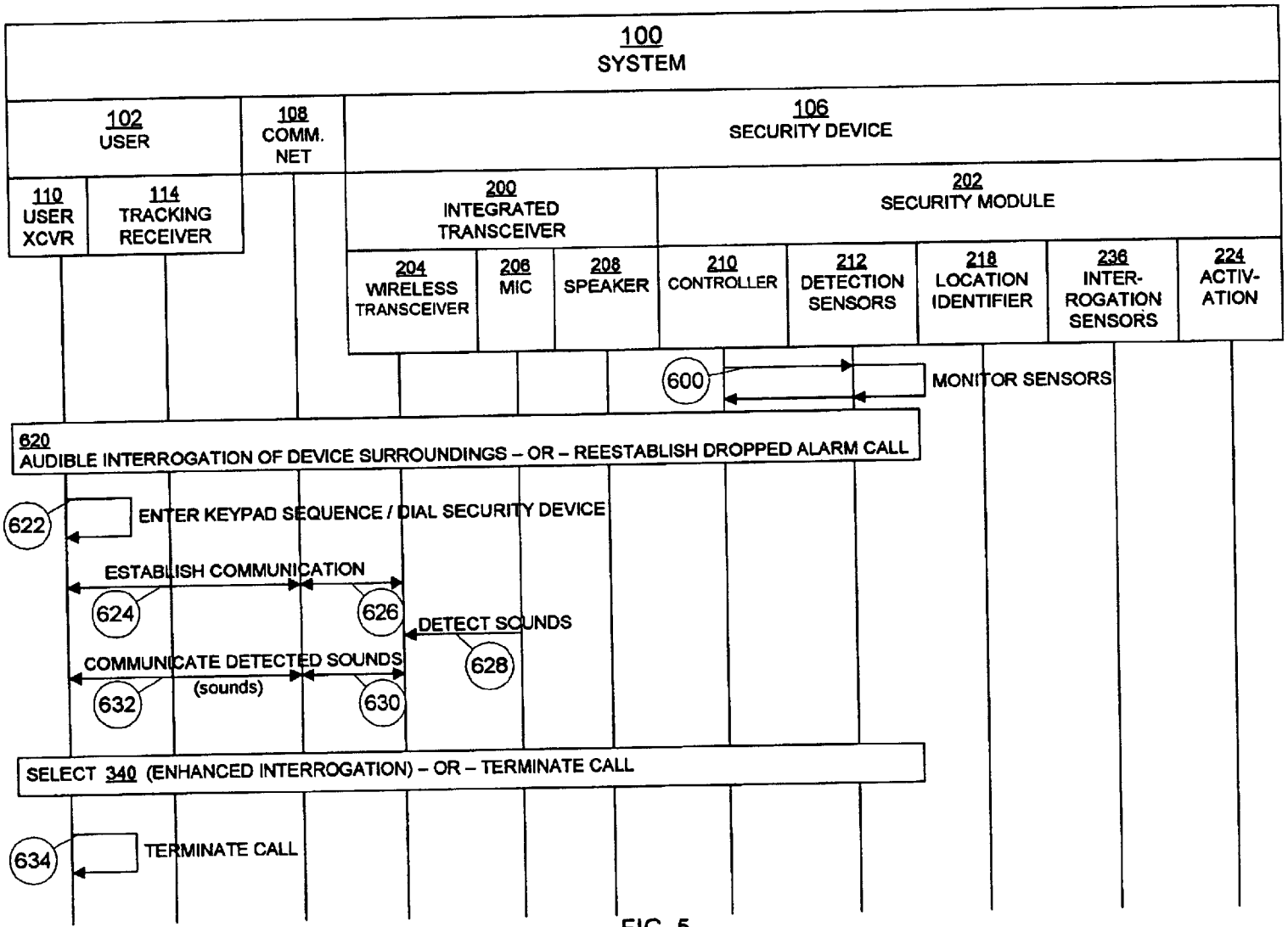
FIG. 5 is a flow diagram of a monitoring method, in accordance with a preferred embodiment of the present invention.

FIG. 5 illustrates a user-initiated interrogation of the device surroundings, in accordance with the present invention. The present invention contemplates a scenario where a user may initiate a contact with a security device to evaluate the status of the security device including any surrounding conditions perceivable to the security device. In such a scenario, the controller and sensors are undergoing monitoring in a step 600 representative of an activated sensor state described above. In a procedure 620 a user initiates the establishment of a communication link over communication network 108 for one of various reasons, such as (i) the afore described desire by the user to evaluate the security device or its surroundings or (ii) to reestablish a dropped call which may have been initiated by the security device in response to detection sensor activation.

In a step 622, a user enters a keypad sequence and initiates a call to security device 106. A communication link is established over communication network 108 in steps 624 and 626. Once a communication link has been established between user transceiver 110 and wireless transceiver 204, a sensor such as microphone 206 detects sounds, in a step 628, and forwards those sounds/data, in steps 630 and 632, to user transceiver 110 for perception and evaluation by user 102. Should the user desire enhanced interrogation, the user may proceed to query interrogation sensors 236 according to procedure 240 described above. When a user concludes audible interrogation and any optional enhanced interrogation, the user terminates the call in a step 634 and the system resumes its monitoring state. Alternatively, the user when a communication link is established, deactivate sensors 212 or perform other controlling functions relating to the security device through the use of a keypad sequence, such as placing security device into a standby or inactive state.

Figure 6:
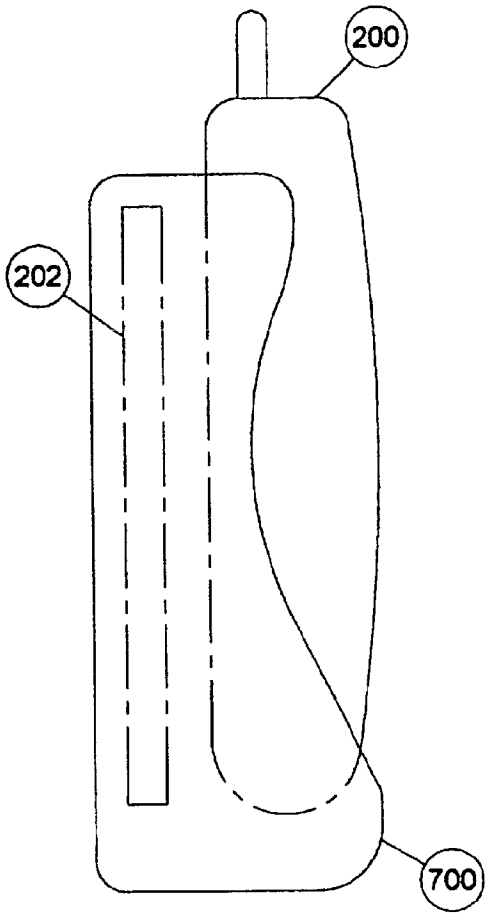
FIG. 6 is a mechanical embodiment of an integrated transceiver and a security module, in accordance with an embodiment of the present invention.

FIG. 6 illustrates a mechanical arrangement of an integrated transceiver 200 being received within a housing 700 that includes a security module 202 and the associated mechanical coupling of integrated transceiver 200. Integrated transceiver 200 assumes a generally integrated handset form-factor providing transceiving functionality as described above in relation to wireless transceiver 204 and further includes microphone 206 and speaker 208 with general interfaces 214 and 234 (all of FIG. 3).

Also illustrated in FIG. 6 is a housing 700 that generally attaches or receives integrated transceiver 200, which in one exemplary embodiment, receives integrated transceiver 200 and electrically mates with exposed electrical contacts (e.g., hands-free or modem-coupling interfaces) for coupling with a security module 200 integrated within housing 700. It should be appreciated that housing 700 may mate with integrated transceiver in either a "holster-like" receiving arrangement or snap or otherwise couple to the back either over or instead of the battery portion of the integrated handset. Those of skill in the art appreciate other mounting and interfacing techniques that may equally provide coupling of the security module with the integrated transceiver. Such additional coupling alternatives are contemplated within the scope of the present invention.

While the present illustration contemplates an integrated transceiver, it is also contemplated that general transceiver functionality may be provided in a "raw" circuit board configuration to be further packaged in another form-factor exhibiting similar functionality. Also contemplated is an embodiment that integrates the transceiver functionality and the security module functionality into a single integrated device. Further contemplated is and embodiment that is integrated within a larger assembly, such as a vehicle or other device, wherein the control functionality such as an on-board computer may be utilized to provide controller functionality and share yet other sensors, transceivers and the like.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A security device for attaching to personal property for monitoring by a user, comprising:

a security module configured for initiating a dialing command in response to an alarm generated by a detection sensor capable of monitoring a condition relating to the personal property; and an integrated wireless transceiver operably coupled to said security module including a user programmed dialing string corresponding with a user transceiver for notification of the alarm, the wireless transceiver configured for establishing a communication link with the user transceiver upon receipt of the dialing command, wherein the security device is sized and adapted such that it is usable with a variety of different types of personal property.

2. The security device for attaching to personal property, as in claim 1, wherein the wireless transceiver further comprises a microphone for communicating audible condition information characteristic of conditions surrounding the security device to the communication link for delivery to the user transceiver over the communication link in response to the alarm.

3. The security device for attaching to personal property, as in claim 1, wherein the user programmed dialing string is reprogrammable.

4. The security device for attaching to personal property, as in claim 1, wherein the security module further comprises:

an interrogation sensor for accumulating additional condition information surrounding the security device and forwarding the additional condition information to the user transceiver by way of the wireless transceiver of the security device.

5. A security device as in claim 1 wherein the security module is totally self-contained.

6. The security device for attaching to personal property, as in claim 1, further comprising a location identifier to identify to the user a location of the security device.

7. The security device for attaching to personal property, as in claim 6, wherein the location identifier is a tracking transmitter configured to transmit a tracking signal locatable by the user.

8. The security device for attaching to personal property, as in claim 6, wherein the location identifier is a receiver to interpret location coordinates of the security device and forward the coordinates to the user transceiver by way of the wireless transceiver.

9. The security device for attaching to personal property, as in claim 6, wherein the location identifier is activatable by the user transceiver.

10. The security device for attaching to personal property, as in claim 6, wherein the location identifier remains inactive following the alarm generated by the detection sensor for a predetermined period of time.

11. A system for securing personal property, comprising:

a security device for associating with personal property, the security device comprising a security module configured to initiate a dialing command in response to an alarm generated by a detection sensor capable of monitoring a condition relating to the personal property and a security device transceiver operably coupled to the security module which includes a user programmed dialing string to be initiated upon receipt of the dialing command from the security module, the security device transceiver capable of establishing a communication link according to the user programmed dialing string; and a user transceiver responsive to the user programmed dialing string to cooperatively form the communication link with the security device transceiver in response to the alarm, wherein the security device is sized and adapted such that it is usable with a variety of different types of personal property.

12. The system, as in claim 11, wherein the security module further comprises an interrogation sensor configured to accumulate additional condition information surrounding the security device and forwarding the additional condition information to the user transceiver by way of the integrated transceiver of the security device.

13. The system for securing personal property, as in claim 11, further comprising a location identifier to identify to the user a location of the security device.

14. The system, as in claim 13 wherein the location identifier is a tracking transmitter to transmit a tracking signal locatable by the user.

15. The system, as in claim 14, further comprising: a tracking receiver configured to receive the tracking signal allowing the user to locate the security device.

16. The system, as in claim 13, wherein the location identifier is a receiver configured to interpret location coordinates of the security device and forward the location coordinates to the user transceiver by way of the security device transceiver.

17. A security module for coupling with a cellular telephone, comprising:

a detection sensor capable of monitoring a condition relating to personal property and generating an alarm upon detection of a specific state of the condition;

a controller in electrical communication with the detection sensor, said controller comprising a cellular telephone for initiating a dialing command to the cellular telephone in response to the alarm from the detection sensor to establish a communication link with a user telephone; and wherein the security module cooperates with the cellular telephone to monitor personal property, and wherein the security device is sized and adapted such that it is usable with a variety of different types of personal property.

18. The security module, as in claim 17, further comprising an interrogation sensor to accumulate additional condition information surrounding the security module, wherein the controller forwards the additional condition information to the user telephone by way of the cellular telephone.

19. The security module, as in claim 17, further comprising a location identifier to identify to the user telephone a location of the security module.

20. In a security system, a method for monitoring personal property comprising:

programming a user-defined dialing string into a cellular telephone;

associating a security module, having a detection sensor capable of monitoring a condition relating to the personal property, with the cellular telephone to form a security device;

attaching the security device to the personal property to be monitored, the security device being sized and adapted such that it is usable with a variety of different types of personal property; and upon detection of an alarm of a condition monitored by the detection sensor, establishing a communication link according to the programmed dialing string with a user telephone.

21. In a security system, the method, as in claim 20, further comprising:

communicating audible conditions near the security device to the user telephone over the communication link.

22. In a security system, the method, as in claim 21, further comprising:

activating a location identifier near the security module to enable the user to locate the security device associated with the personal property.

23. A personal property security device, comprising:

a detection sensor capable of monitoring a condition relating to the personal property and generating an alarm upon detection of a specific state of the condition;

a controller in electrical communication with the detection sensor for initiating a dialing command in response to the alarm from the detection sensor; and a wireless transceiver in electrical communication with the controller having a user programmed dialing string corresponding with a user transceiver for notification of the alarm, the wireless transceiver configured to establish a communication link with the user transceiver upon receipt of the dialing command from the controller, wherein the security device is sized and adapted such that it is usable with a variety of different types of personal property.

24. A security device for attaching to personal property for monitoring by a user, comprising:

a security module configured for initiating a dialing command in response to an alarm generated by a detection sensor capable of monitoring a condition relating to the personal property; and an integrated wireless transceiver operably coupled to said security module including a user programmed dialing string corresponding with a user transceiver for notification of the alarm, the wireless transceiver configured for establishing a communication link with the user transceiver upon receipt of the dialing command, wherein the security module is capable of executing remote programming commands issued by the user.

25. A security device as in claim 24 wherein the security module is capable of executing a remote programming command to activate or deactivate the detection sensor.

26. A security device as in claim 24 wherein the security module is capable of executing a remote programming command to reset the sensors.

27. A security device as in claim 24 the security module is capable of executing a remote programming command to activate or deactivate the security module.

28. A security device as in claim 24 wherein the security module is capable of executing a remote programming command to activate an interrogation sensor.

29. A security device as in claim 24 wherein the security module is capable of executing a remote programming command to evaluate the status of the security device.

* * * * *